US012253262B2

(12) United States Patent
Wu et al.

(10) Patent No.: US 12,253,262 B2
(45) Date of Patent: Mar. 18, 2025

(54) IGNITION DEVICE OF GAS COOKTOP AND GAS COOKTOP

(71) Applicant: BSH Hausgeräte GmbH, Munich (DE)

(72) Inventors: Jinhua Wu, Nanjing (CN); Peter Schlotmann, Bretten (DE); Weiwei Miao, Nanjing (CN)

(73) Assignee: BSH Hausgeräte GmbH, Munich (DE)

( * ) Notice: Subject to any disclaimer, the term of this patent is extended or adjusted under 35 U.S.C. 154(b) by 402 days.

(21) Appl. No.: 17/642,969

(22) PCT Filed: Sep. 17, 2020

(86) PCT No.: PCT/EP2020/075943

§ 371 (c)(1),
(2) Date: Mar. 15, 2022

(87) PCT Pub. No.: WO2021/058362

PCT Pub. Date: Apr. 1, 2021

(65) Prior Publication Data

US 2022/0390107 A1 Dec. 8, 2022

(30) Foreign Application Priority Data

Sep. 24, 2019 (CN) ..... 201921597479.6

(51) Int. Cl.
*F23Q 3/00* (2006.01)
*F24C 3/10* (2006.01)

(52) U.S. Cl.
CPC ..... *F23Q 3/008* (2013.01); *F24C 3/103* (2013.01)

(58) Field of Classification Search
CPC ..... F23Q 3/008; F24C 3/103
USPC ..... 431/258
See application file for complete search history.

(56) References Cited

U.S. PATENT DOCUMENTS 4,358,813 A 11/1982 Sato
4,468,543 A * 8/1984 Sone ..... F02P 7/025 200/264
4,695,245 A * 9/1987 Kotzmann ..... F23D 11/001 239/404

(Continued)

FOREIGN PATENT DOCUMENTS

CN 108626755 A 10/2018
JP H06347037 A 12/1994
JP 2015049029 A 3/2015

OTHER PUBLICATIONS

International Search Report PCT/EP2020/075943 dated Dec. 4, 2020.

*Primary Examiner* — Avinash A Savani
(74) *Attorney, Agent, or Firm* — Michael E. Tschupp; Andre Pallapies; Brandon G. Braun

(57) ABSTRACT

An ignition device of a gas cooktop, and a gas cooktop. The ignition device of the gas cooktop includes a discharge end, a receiving end and an ignition control module. An ignition frequency generated by the ignition control module is within a range of [15 kHz, 22 kHz], a distance between the discharge end and the receiving end is within a range of [2 mm, 5 mm], and at ignition, a continuous arc is generated between the discharge end and the receiving end to ignite gas. When the ignition device of this scheme is ignited, an ignition sound is extremely low and there is no noise pollution.

20 Claims, 2 Drawing Sheets

(56) References Cited

U.S. PATENT DOCUMENTS

| | | | | | |
|---|---|---|---|---|---|
| 5,492,469 | A * | 2/1996 | Oda | F23D 14/06 | 431/263 |
| 5,793,585 | A | 8/1998 | Cowan | | |
| 6,144,172 | A * | 11/2000 | Sun | H05B 41/2928 | 315/307 |
| 2002/0079800 | A1 * | 6/2002 | Miyashita | H01T 13/39 | 313/143 |

* cited by examiner

IGNITION DEVICE OF GAS COOKTOP AND GAS COOKTOP

CROSS-REFERENCES TO RELATED APPLICATIONS

This application is the U.S. National Stage of International Application No. PCT/EP2020/075943, filed Sep. 17, 2020, which designated the United States and has been published as International Publication No. WO 2021/058362 A1 and which claims the priority of Chinese Patent Application, Ser. No. 201921597479.6, filed Sep. 24, 2019, pursuant to 35 U.S.C. 119(a)-(d).

The contents of International Application No. PCT/EP2020/075943 and Chinese Patent Application, Ser. No. 201921597479.6 are incorporated herein by reference in their entireties as if fully set forth herein.

FIELD OF THE TECHNOLOGY

The present application relates to the field of gas cooktops, in particular to an ignition device for a gas cooktop and a gas cooktop including the ignition device.

BACKGROUND OF THE DISCLOSURE

At present, most gas cooktops use a high-voltage pulse to ignite gas. A frequency of the high-voltage pulse for ignition is generally within 6 to 10 Hz, and at ignition, high-decibel noise is generated, which disturbs users and brings bad experience to users.

SUMMARY

An object of the present application is to provide an improved ignition device of a gas cooktop and a gas cooktop including the ignition device, to resolve the above technical problems.

Another object of the present application is to provide a low-noise ignition device of a gas cooktop and a gas cooktop including the ignition device, to resolve the above technical problems.

One aspect of embodiments of the present application relates to an ignition device of a gas cooktop. The ignition device of a gas cooktop includes a discharge end, a receiving end and an ignition control module, where an ignition frequency generated by the ignition control module is within a range of 15 kHz to 22 kHz, a distance between the discharge end and the receiving end is within a range of 2 mm to 5 mm, and at ignition, a continuous arc is generated between the discharge end and the receiving end to ignite gas.

The ignition sound generated by spark discharge is due to the fact that high voltage breaks through the air and air vibration generates sound waves. The sound waves are transmitted from a positive electrode to a negative electrode (forward sound waves), and are reflected at the negative electrode (reverse sound waves). The forward and reverse sound waves are opposite in phase. When an ignition frequency is high, the reverse sound waves offset the forward sound waves in time, and therefore the sound is low.

According to the above technical scheme of the present application, the ignition frequency within the range of [15 kHz, 22 kHz] is generated by the ignition control module. When the distance between the discharge end and the receiving end is within the range of [2 mm, 5 mm], the ignition frequency is high. After a large number of tests, a sound at ignition is extremely low and there is no noise pollution.

It is to be noted that in the above scheme, the range is represented by a mathematical expression. The ignition frequency is within the range of [15 kHz, 22 kHz]. It is to be understood that the range of the ignition frequency includes two end values, namely, 15 kHz and 22 kHz. Similarly, the distance between the discharge end and the receiving end is within the range of [2 mm, 5 mm], and it is to be understood that the range of the distance between the discharge end and the receiving end includes two end values, namely, 2 mm and 5 mm.

In one or more embodiments, the distance between the discharge end and the receiving end is within a range of [2 mm, 3 mm]. As an ignition distance increases, an arc between the discharge end and the receiving end becomes unstable easily, and it is difficult to make a discharge direction of the discharge end fixedly towards the receiving end. As a result, spark energy is not concentrated and it is not easy to ignite quickly. When the ignition frequency is fixed, the ignition sound is related to the ignition distance (namely, a distance between the discharge end and the receiving end). Within a reasonable ignition distance (the so-called reasonable ignition distance means that a stable arc can be generated within this distance), as the ignition distance increases, sound waves propagate faster, and thus the momentum of collision increases. According to the law of conservation of momentum $mv=Ft$, a force increases, and therefore, an amplitude of sound waves increases and the ignition sound becomes louder. When the distance between the discharge end and the receiving end is within the range of [2 mm, 3 mm], the arc is stable, the discharge direction is fixed, and spark energy is more concentrated. Therefore, it is easier to ignite quickly. Moreover, the ignition sound is lower and almost inaudible, so that silent ignition is basically realized.

In one or more embodiments, the ignition frequency generated by the ignition control module is within a range of [15 kHz, 20 kHz]. As the ignition frequency increases, it generates higher total energy and causes higher energy consumption, and parts need to meet higher requirements. This is uneconomical in terms of manufacturing cost. With an increase in the total energy, the ignition efficiency is increased. However, greater possible damages may be caused, for example, repeated discharge at the discharge end, easy carbonization, and a short service life.

In one or more embodiments, the ignition device of a gas cooktop includes a spark electrode. The spark electrode includes two electrode terminals. One of the electrode terminals is the discharge end, and the other electrode end is the receiving end. Because both the discharge end and the receiving end are set on the spark electrode, accumulation of assembly tolerance between different parts is avoided. In this scheme, the distance between the discharge end and the receiving end can be controlled more accurately.

In one or more embodiments, the ignition device of a gas cooktop includes a spark electrode, the spark electrode includes four electrode terminals, and the four electrode terminals form two discharge ends and two receiving ends; at ignition, a continuous arc generated between one pair of the electrode terminals and a continuous arc generated between the other pair of the electrode terminals intersect each other. In this way, ignition is successful in a shorter time, ignition efficiency is improved, and ignition is faster. That "a continuous arc generated between one pair of the electrode terminals and a continuous arc generated between the other pair of the electrode terminals intersect each other"

should include cases that two arcs meet in space, and that orthographic projections of two arcs intersect although the two arcs do not meet in space.

In one or more embodiments, the gas cooktop includes a burner, the ignition device includes a spark electrode, and the spark electrode includes an electrode terminal. The electrode terminal is the discharge end, and the receiving end is formed on the burner.

In one or more embodiments, the gas cooktop includes a thermocouple, the ignition device includes a spark electrode, and the spark electrode includes an electrode terminal. The electrode terminal is the discharge end, and the receiving end is an end of the thermocouple.

In one or more embodiments, a diameter of the discharge end is less than or equal to 2 mm, and/or a diameter of the receiving end is less than or equal to 2 mm. The discharge end and/or the receiving end needs to be as sharp as possible. When the diameter of the discharge end and the receiving end is greater than 2 mm, the direction of the arc is not fixed and may drift.

In one or more embodiments, the ignition frequency generated by the ignition control module is 18.2 KHZ, and the distance between the discharge end and the receiving end is 2 mm. In a scheme of this embodiment, at ignition, people can hardly hear an ignition sound.

In one or more embodiments, the ignition frequency generated by the ignition control module is 15 KHZ, and the distance between the discharge end and the receiving end is 4 mm. Noise at ignition is low.

In one or more embodiments, the ignition frequency generated by the ignition control module is 20 KHZ, and the distance between the discharge end and the receiving end is 5 mm. In a scheme of this embodiment, there is no ignition noise at ignition.

In one or more embodiments, the distance between the discharge end and the receiving end is 3 mm. An appropriate ignition frequency is selected by the ignition control module, and almost no noise is generated by the ignition device at ignition.

In one or more embodiments, the ignition frequency generated by the ignition control module is 22 KHZ, the distance between the discharge end and the receiving end is adjusted through experiments, and the ignition device can realize extremely low noise at ignition and does not disturb users.

Another embodiment of the present application relates to a gas cooktop, and the gas cooktop includes an ignition device described in any one of the above embodiments.

It is to be pointed out that features of dependent claims may be combined with each other in any way and with features of independent claims without departing from the concept of the present application.

DESCRIPTION OF EMBODIMENTS

For a further understanding of the objectives, structures, features and functions of the present application, a detailed description is made below in cooperation with embodiments.

An ignition device 2 of a gas cooktop 1 includes a discharge end 100, a receiving end 200, and an ignition control module. An ignition frequency generated by the ignition control module is within a range of [15 kHz, 20 kHz]. A distance between the discharge end 100 and the receiving end 200 is within a range of [2 mm, 5 mm], and at ignition, a continuous arc is generated between the discharge end 100 and the receiving end 200 to ignite gas.

Figure 1:
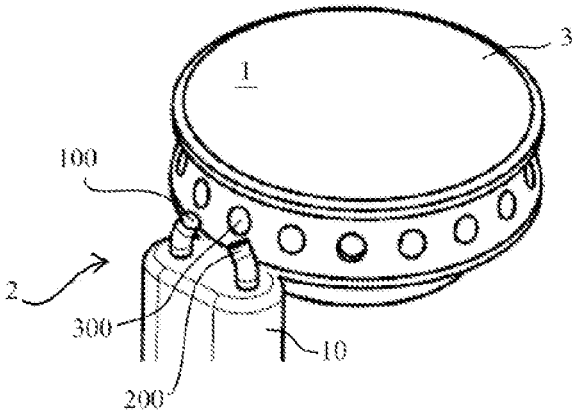
FIG. 1 is a schematic diagram of a gas cooktop and its ignition device according to an embodiment of the present application.

FIG. 1 is a schematic diagram of a gas cooktop and its ignition device according to an embodiment of the present application. As shown in FIG. 1, an ignition device of this embodiment includes a spark electrode 10, the spark electrode 10 includes an electrode 11 and a housing 12 wrapped outside the electrode 11, and the housing 12 is made of a ceramic material. An end of the electrode 11 is exposed out of the housing 12 (shown in FIG. 2).

The spark electrode 10 of this embodiment includes two electrode terminals. One of the electrode terminals is used as the discharge end 100 and the other as the receiving end 200. The discharge end 100 and the receiving end 200 are respectively connected to a positive electrode and a negative electrode of an ignition coil. Moreover, both the discharge end 100 and the receiving end 200 both have a diameter less than or equal to 2 mm, and are relatively sharp, which helps stabilize a discharge arc, so that the arc generated by the discharge end 100 is towards the receiving end 200 fixedly rather than other directions, such as towards a burner 3.

In this embodiment, the distance between the discharge end 100 and the receiving end 200 is 2 mm, and the ignition frequency generated by an ignition control module is 18.2 KHZ, to ignite gas flowing out from a fire hole 300 of the burner 3. In this scheme, when an ignition device 2 generates extremely low ignition sound at ignition, which is almost inaudible.

Figure 2:
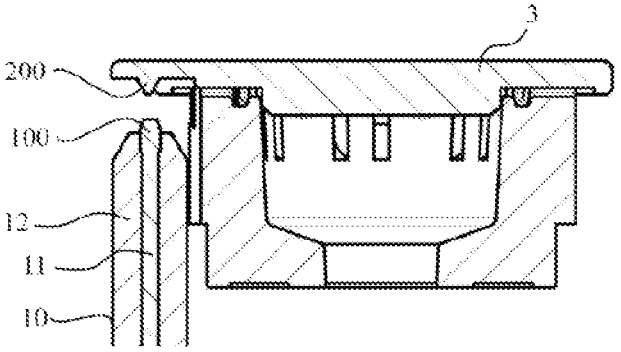
FIG. 2 is a schematic diagram of a gas cooktop and its ignition device according to another embodiment of the present application.

FIG. 2 is a schematic diagram of a gas cooktop and its ignition device according to another embodiment of the present application. A gas cooktop 1 includes a burner 3, and an ignition device 2 includes a spark electrode 10. In this embodiment, structures the same as those in the foregoing embodiment are represented by same reference numerals, and have same or similar functions or effects, which will not be repeated here. Different from the foregoing embodiment, the spark electrode 10 in this embodiment includes an electrode end, the electrode end is the discharge end 100, and the receiving end 200 is formed on the burner 3. As shown in FIG. 2, a sharp protrusion is formed on the burner 3. The protrusion is grounded and serves as the receiving end 200. In this embodiment, a distance between the discharge end 100 and the receiving end 200 is 5 mm, and an ignition frequency generated by an ignition control module is 20 KHZ, to ignite gas flowing out from a fire hole 300 of the burner 3. In this scheme, the ignition device 2 generates no noise at ignition, and a stable and continuous arc can be generated between the discharge end 100 and the receiving end 200.

In another embodiment, the ignition frequency generated by the ignition control module is 15 KHZ, and the distance between the discharge end 100 and the receiving end 200 is 4 mm. In this embodiment, noise-free ignition can also be realized.

In some embodiments, the ignition frequency generated by the ignition control module is set to 22 KHZ, a suitable value within a range of [2 mm, 5 mm] is selected as the distance between the discharge terminal 100 and the receiving end 200, where the value is determined through experiment, and a noise-free ignition can be realized. In other embodiments, the distance between the discharge end 100 and the receiving end 200 is set to 3 mm, and the ignition frequency of the ignition control module is adjusted within a range of [15 kHz, 22 kHz], which can also realize low ignition noise.

In addition, in another embodiment of the present application, an ignition device is as follows: A gas cooktop includes a thermocouple, an ignition device 2 includes a spark electrode 10, and the spark electrode 10 includes an electrode end. The electrode end is a discharge end, and a receiving end is an end of the thermocouple.

Figure 3:
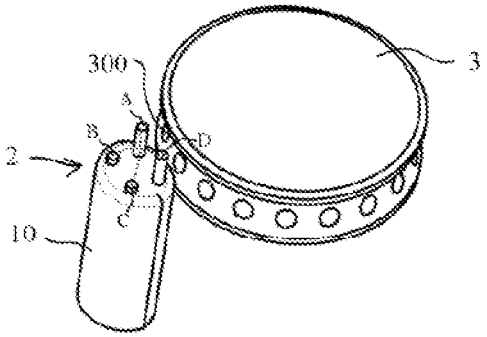
FIG. 3 is a schematic diagram of a gas cooktop and its ignition device according to still another embodiment of the present application.

FIG. 3 is a schematic diagram of a gas cooktop and its ignition device according to still another embodiment of the present application. In this embodiment, structures the same as those in the foregoing embodiment are represented by same reference numerals, and have same or similar functions or effects, which will not be repeated here. Differences between this embodiment and the foregoing embodiments are that a spark electrode 10 includes four electrode terminals, namely A, B, C and D. The four electrode terminals A, B, C and D form two discharge ends and two receiving ends. At ignition, a continuous arc generated between the electrode terminals A and C (an arc is represented by dashed lines in FIG. 3) intersects a continuous arc generated between the electrode terminals B and D. In this way, ignition efficiency is improved and ignition is faster.

In the present application, an embodiment relates to a gas cooktop 1, and the gas cooktop 1 includes an ignition device 2 described in any one of the above embodiments.

Various embodiments of a single component illustrated with reference to FIGS. 1 to 3 may be combined with each other in any given manner to realize the advantage of the present application.

The present application has been described by the foregoing related embodiments, but the foregoing embodiments are only examples for implementing the present application. It is to be pointed out that the disclosed embodiments do not limit a scope of the present application. On the contrary, changes and modifications made without departing from the spirit and scope of the present application fall within the protection scope of the present application.

What is claimed is:

1. An ignition device of a gas cooktop, comprising:

a discharge end;

a receiving end spaced from the discharge end at a distance within a range of 2 mm-5 mm; and an ignition control module configured to generate an ignition frequency within a range of 15 kHz-22 kHz, wherein at ignition, a continuous arc is generated between the discharge end and the receiving end to ignite gas.

2. The ignition device of claim 1, wherein the distance between the discharge end and the receiving end is within a range of 2 mm-3 mm.

3. The ignition device of claim 1, wherein the ignition frequency generated by the ignition control module is within a range of 15 kHz-20 kHz.

4. The ignition device of claim 1, further comprising a spark electrode comprising two electrode terminals, wherein one of the electrode terminals is the discharge end, and the other one of the electrode terminals is the receiving end.

5. The ignition device of claim 1, further comprising a spark electrode comprising four electrode terminals which are configured to two discharge ends and two receiving ends, wherein at ignition, a continuous arc generated between one pair of the electrode terminals and a continuous arc generated between the other pair of the electrode terminals intersect each other.

6. The ignition device of claim 1, further comprising a spark electrode comprising an electrode terminal, wherein the electrode terminal forms the discharge end, with the receiving end being formed on a burner of the gas cooktop.

7. The ignition device of claim 1, further comprising a spark electrode comprising an electrode terminal, wherein the electrode terminal forms the discharge end, with the receiving end being formed by an end portion of a thermocouple of the gas cooktop.

8. The ignition device of claim 1, wherein at least one of the discharge end and the receiving end has a diameter which is less than or equal to 2 mm.

9. The ignition device of claim 1, wherein the ignition frequency generated by the ignition control module is 18.2 KHZ, and the distance between the discharge end and the receiving end is 2 mm.

10. The ignition device of claim 1, wherein the ignition frequency generated by the ignition control module is 20 KHZ, and the distance between the discharge end and the receiving end is 5 mm.

11. The ignition device of claim 1, wherein the ignition frequency generated by the ignition control module is 15 KHZ, and the distance between the discharge end and the receiving end is 4 mm.

12. A gas cooktop, comprising an ignition device, said ignition device comprising a discharge end, a receiving end spaced from the discharge end at a distance within a range of 2 mm-5 mm, and an ignition control module configured to generate an ignition frequency within a range of 15 kHz-22 kHz, wherein at ignition, a continuous arc is generated between the discharge end and the receiving end to ignite gas.

13. The gas cooktop of claim 12, wherein the distance between the discharge end and the receiving end is within a range of 2 mm-3 mm.

14. The gas cooktop of claim 12, wherein the ignition frequency generated by the ignition control module is within a range of 15 kHz-20 kHz.

15. The gas cooktop of claim 12, wherein the ignition device comprises a spark electrode comprising two electrode terminals, wherein one of the electrode terminals is the discharge end, and the other one of the electrode terminals is the receiving end.

16. The gas cooktop of claim 12, wherein the ignition device comprises a spark electrode comprising four electrode terminals which are configured to two discharge ends and two receiving ends, wherein at ignition, a continuous arc generated between one pair of the electrode terminals and a continuous arc generated between the other pair of the electrode terminals intersect each other.

17. The gas cooktop of claim 12, further comprising a burner, said ignition device comprising a spark electrode comprising an electrode terminal, wherein the electrode terminal forms the discharge end, with the receiving end being formed on the burner.

18. The gas cooktop of claim 12, further comprising a thermocouple, said ignition device comprising a spark electrode comprising an electrode terminal, wherein the electrode terminal forms the discharge end, with the receiving end being formed by an end portion of the thermocouple.

19. The gas cooktop of claim 12, wherein at least one of the discharge end and the receiving end of the ignition device has a diameter which is less than or equal to 2 mm.

20. The gas cooktop of claim 12, wherein the ignition frequency generated by the ignition control module of the ignition device is 18.2 KHZ, and the distance between the discharge end and the receiving end of the ignition device is 2 mm.

* * * * *